United States Patent [19]

Grunder

[11] Patent Number: 4,792,076

[45] Date of Patent: Dec. 20, 1988

[54] WEB TRANSPORTING APPARATUS

[75] Inventor: Roland Grunder, Vordemwald, Switzerland

[73] Assignee: GRAPHA-Holding AG, Hergiswil, Switzerland

[21] Appl. No.: 61,866

[22] Filed: Jun. 11, 1987

[30] Foreign Application Priority Data

Jul. 21, 1986 [CH] Switzerland ..... 2915/86

[51] Int. Cl.[4] ..... B65H 20/02; B65H 75/24

[52] U.S. Cl. ..... 226/175; 226/191; 242/72 B

[58] Field of Search ..... 226/174, 175, 168, 191; 242/68.2, 72 B

[56] References Cited

U.S. PATENT DOCUMENTS

| | | | |
|---|---|---|---|
| 2,621,867 | 12/1952 | Grettve | 242/72 B |
| 2,711,863 | 6/1955 | Grettve | 242/72 B |
| 2,765,165 | 10/1956 | Johnson | 226/175 X |
| 3,096,949 | 7/1963 | Huffman | 242/72 B |
| 3,295,188 | 1/1967 | Saueressig | 242/72 B X |
| 3,377,824 | 4/1968 | Moyer | 226/175 X |
| 4,541,585 | 9/1985 | Frye et al. | 242/72 B X |

FOREIGN PATENT DOCUMENTS

| | | | |
|---|---|---|---|
| 26081 | 8/1956 | Fed. Rep. of Germany | 226/175 |

*Primary Examiner*—John Petrakes
*Assistant Examiner*—Joseph J. Hail, III
*Attorney, Agent, or Firm*—Peter K. Kontler

[57] ABSTRACT

A web transporting apparatus wherein the web is trained over the external surface of a radially expandible elastic shell which is connected with two end walls to form a roll and to define an internal compartment which is filled with a pressurized hydraulic fluid. The pressure of hydraulic fluid is regulated in dependency upon the thickness of the web which is being transported so that the neutral zone of the web is invariably located at the same distance from the axis of the roll. The pressure of fluid in the compartmnt is regulatable by a hydropneumatic transducer wherein a hydraulic cylinder and piston unit admits pressurized hydraulic fluid into the compartment and the pressure of fluid in the hydraulic cylinder and piston unit is regulated by a pneumatic cylinder and piston unit which receives pressurized gaseous fluid by way of an adjusting valve. Regulation of the outer diameter of the shell compensates for variations in the thickness of the transported web. The material of the shell is selected in such a way that it is capable of undergoing a purely elastic deformation within a desired range which depends upon the range of thicknesses of webs which are to be transported in the apparatus.

9 Claims, 1 Drawing Sheet

WEB TRANSPORTING APPARATUS

BACKGROUND OF THE INVENTION

The present invention relates to apparatus for transporting webs or strips of paper, textile material, metallic or plastic foil and the like. More particularly, the invention relates to improvements in apparatus of the type wherein the transported web or strip (hereinafter called web) is in contact with the external surface of the cylindrical shell of a roll which can be driven by the web or which is driven by a prime mover.

Web transporting apparatus which are used in printing, stamping and many other machines must advance predetermined lengths of a running web per working cycle of the machine, normally per revolution of the roll which is in contact with and which normally serves to advance the web. Problems arise when one and the same apparatus must transport webs of different thicknesses. In accordance with a presently known proposal, the web which is to be transported by a driven roll is stretched ahead of the region of contact with the roll, and the extent of stretching is a function of the thickness of the web. The stretching of the web takes place within the elastic limits of its material. A drawback of such proposal is that one and the same roll can transport only a limited series of webs having different thicknesses. Furthermore, the extent to which a web of textile material, paper or the like can be stretched within elastic limits is relatively small so that it is not always possible to subject the web to a tensional stress which would be necessary in order to enable one and the same roll to transport relatively thin as well as medium thick and reasonably thick webs.

In accordance with a different proposal, the drive for the transporting roll contains a compensating transmission which can correct the rotational speed of the roll in dependency upon the thickness of the web. A drawback of this proposal is that the compensating transmission is complex, bulky and expensive. Furthermore, the compensating transmission is likely to affect the accuracy of the transporting operation because it tends to impart to the roll periodic vibratory and other stray movements. Such stray movements affect the accuracy of transport of the web and prevent the apparatus from invariably advancing identical lengths of the web per unit of time.

OBJECTS AND SUMMARY OF THE INVENTION

An object of the invention is to provide a web transporting apparatus wherein one and the same roll can predictably transport relatively thin as well as medium thick and relatively thick webs with the same degree of accuracy and predictability.

Another object of the invention is to provide an apparatus which need not employ a compensating transmission and wherein the web which is being transported need not be subjected to tensional stresses which depend upon its thickness.

A further object of the invention is to provide a novel and improved web transporting roll for use in the above outlined apparatus.

Still another object of the invention is to provide novel and improved means for influencing the parameters of the roll in dependency upon the thickness of the transported web.

Still another object of the invention is to provide a novel and improved method of predictably transporting predetermined increments of webs or strips of paper, textile material or the like in one and the same apparatus regardless of the thickness of the transported webs.

One feature of the present invention resides in the provision of a web transporting apparatus which comprises a roll including an elastically deformable hollow cylindrical shell having a web-engaging external surface and two end portions. The roll further comprises two end walls which are in sealing engagement with the end portions of the shell so that the shell and the end walls jointly define a fluid-containing internal compartment. The apparatus further comprises regulating means for varying the diameter of the shell, and such regulating means includes means for varying the pressure of fluid in the compartment. Still further, the apparatus comprises means for maintaining the fluid in the compartment at a pressure which is selected by the regulating means. The shell is elastically deformable within a predetermined range which corresponds to a predetermined range of diameters of the external surface of the shell.

The shell can have a wall of substantially constant thickness. Alternatively, the internal surface of the shell (such internal surface surrounds the compartment) can be provided with at least one annular stiffening rib which extends from the internal surface and into the compartment. It is preferred to provide the shell with a plurality of reinforcing ribs which are spaced apart from each other in the axial direction of the shell and each of which increases the resistance of the corresponding portion of the shell to expansion by the fluid in the compartment. This enables the external surface of the shell to assume an undulate shape in response to expansion of the shell by the fluid in the compartment. The reinforcing ribs are preferably equidistant from each other.

A least one of the walls is preferably provided with a passage (such as a channel) which connects the compartment with the aforementioned maintaining means. The fluid in the compartment can be a liquid.

One of the regulating and maintaining means can include a hydraulic cylinder and piston unit. As a rule, the maintaining means will include a hydraulic and cylinder and piston unit. The other of the regulating and maintaining means can include a pneumatic cylinder and piston unit.

The shell can contain a metal; in fact, the entire shell can be made of a suitable metallic alloy which allows for radial expansion of the shell within selected limits.

If the roll is not driven by the web, the roll preferably further comprises a shaft which is coaxial with the shell and is connected with at least one of the end walls, and the apparatus then further comprises drive means for rotating the shaft.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
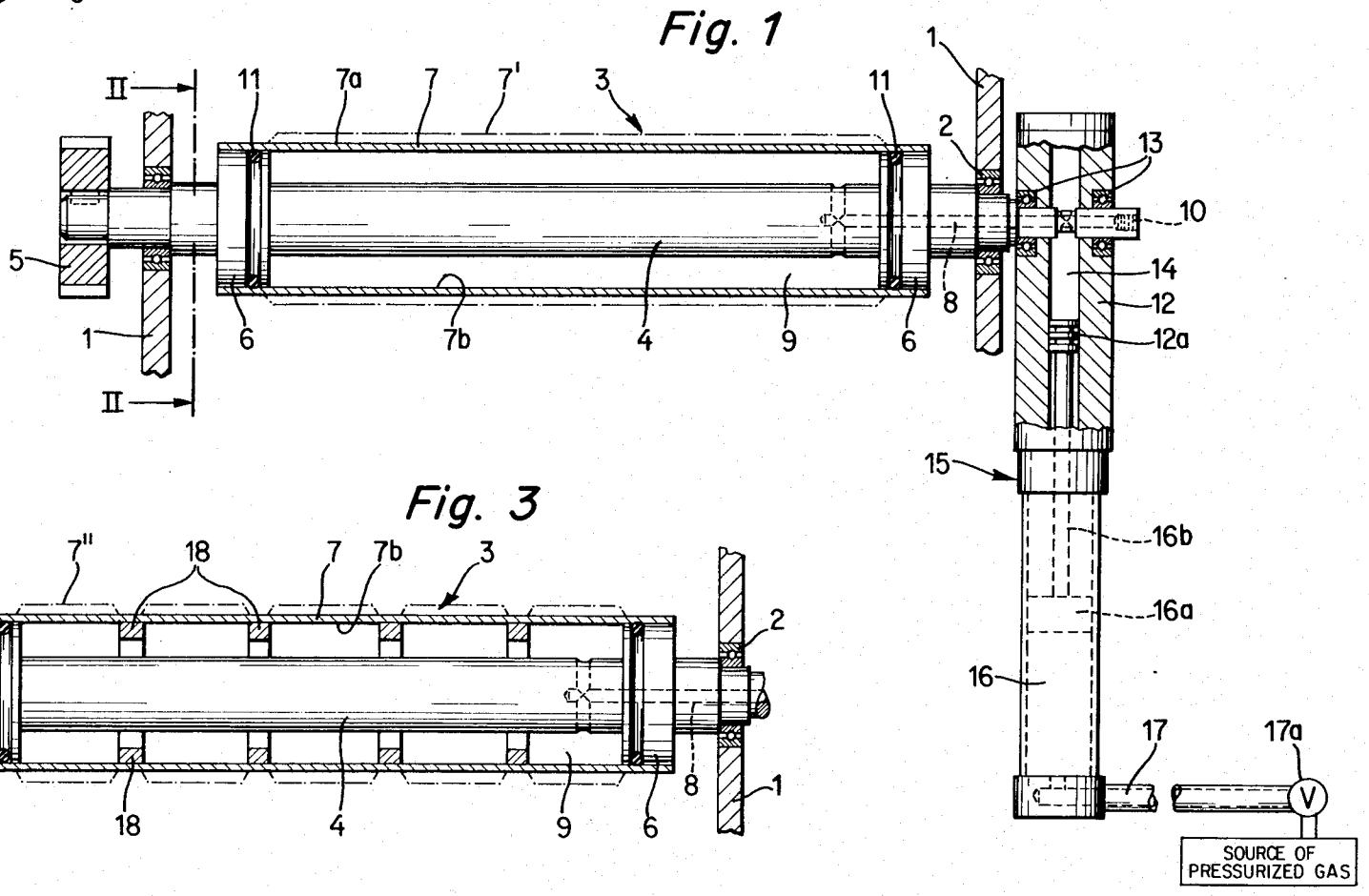
FIG. 1 is a fragmentary partly elevational and partly central vertical sectional view of an apparatus which embodies one form of the invention and wherein the shell of the roll has a constant thickness.
Figure 2:
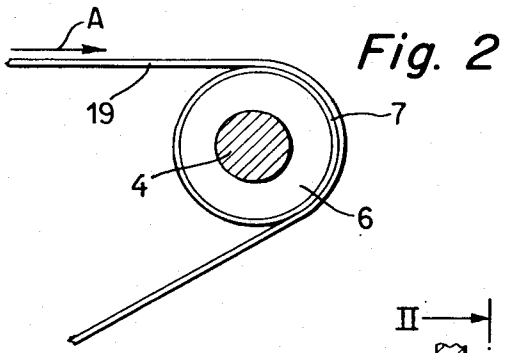
FIG. 2 is a sectional view as seen in the direction of arrows from the line II—II of FIG. 1.

The apparatus which is shown in FIGS. 1 and 2 comprises a frame including two spaced-apart upright frame members or cheeks 1 for antifriction bearings 2 which surround the respective end portions of a horizontal shaft 4 forming part of a web transporting or contacting roll 3. The shaft 4 is coaxial with an elastically deformable hollow cylindrical shell 7 of the roll 3, and the latter further comprises two circular washer-like end walls 6 which are sealingly connected with (e.g., inserted into) the respective end portions of the shell 7. The end walls 6 define with the shell 7 a cylindrical compartment 9 which is surrounded by the cylindrical internal surface **7*b* of the shell 7 and surrounds the central portion of the shaft 4. The shaft 4 is rigid or integral with at least one of the end walls 6**.

The left-hand end portion of the shaft 4 can receive torque from a rotating means including a pinion 5 which is keyed to the shaft 4 and receives motion from a prime mover, not shown (such as a variable-speed electric motor in a printing or stamping machine). The end portions of the shell 7 further contain suitable sealing elements 11 (for example, O-rings) to prevent escape of a hydraulic fluid which fills the compartment 9.

The right-hand end portion of the shaft 4 is provided with a passage 8 in the form of an axially extending channel one end portion of which communicates with the compartment 9 and the other end portion of which communicates with a plenum chamber 14 in a hydraulic cylinder 12 forming part of the means for maintaining the pressure of hydraulic fluid in the compartment 9 at a preselected value. The regulating means which can vary the pressure of fluid in the compartment 9 through the medium of the cylinder 12 and a piston **12*a* therein includes a pneumatic cylinder and piston unit 16 having a piston 16*a* which is connected to the piston 12*a* by a piston rod 16*b*. The cylinder and piston units 12, 12*a* and 16, 16*a* together constitute a hydropneumatic transducer 15. The cylinder 16 can receive a pressurized gaseous fluid by way of a supply conduit 17**.

The passage 8 has an open end in the righthand end portion of the shaft 4, as seen in FIG. 1, and such open end is sealed by a threaded plug 10. The right-hand end portion of the shaft 4 has a reduced diameter and is rotatable in antifriction bearings 13 provided therefor in the cylinder 12. The axis of the right-hand end portion of the shaft 4 crosses the axis of the cylinder 12. The bearings 13 are provided with means for preventing leakage of hydraulic fluid from the plenum chamber 14 in the cylinder 12. The piston **12*a* in the cylinder 12 is provided with sealing rings to prevent penetration of hydraulic fluid into the cylinder 16 and/or penetration of gaseous fluid into the chamber 14**.

The conduit 17 contains a regulating valve **17*a* which can be adjusted manually or automatically in dependency upon the thickness of the web 19 (see FIG. 2) which is trained over the external surface 7*a* of the shell 7. The direction of advancement of the web 19 in response to rotation of the pinion 5 is indicated by the arrow A. The pressure of gaseous fluid which is admitted into the cylinder 16 via conduit 17 is regulated in such a way that the pressure of fluid in the compartment 9 is increased if the web 19 is relatively thin and the pressure in the chamber 14 and compartment 9 is reduced if the web 19 is relatively thick. The diameter of the elastically deformable shell 7 increases or decreases as a function of selected pressure of fluid which fills the compartment 9. The just mentioned regulation of the diameter of the external surface 7*a* of the shell 7 ensures that the neutral zone of the transported web is invariably located at a fixed distance from the axis of the shaft 4** irrespective of the thickness of the web.

The phantom line 7' indicates in FIG. 1 the external surface of the shell 7 when the latter expanded by pressurized fluid in the compartment 9 because the web 19 which is transported by the roll 3 is relatively thin.

The end walls 6 of the roll can be made of steel and the shell 7 is made of an elastic deformable material, particularly a light metal alloy. The length of the web portion which is transported per revolution of the roll 3 increases if the diameter of the shell is increased and vice versa. As mentioned above, the pressure in the compartment 9 will be increased if the material of the web 19 is relatively thin. This ensures that the radius of the neutral zone of the transported web will remain constant regardless of the thickness of the web. In other words, variations of the outer diameter of the shell 7 compensate for variations of the thicknesses of successively transported webs or of the thicknesses of successively transported sections of one and the same web.

Figure 3:
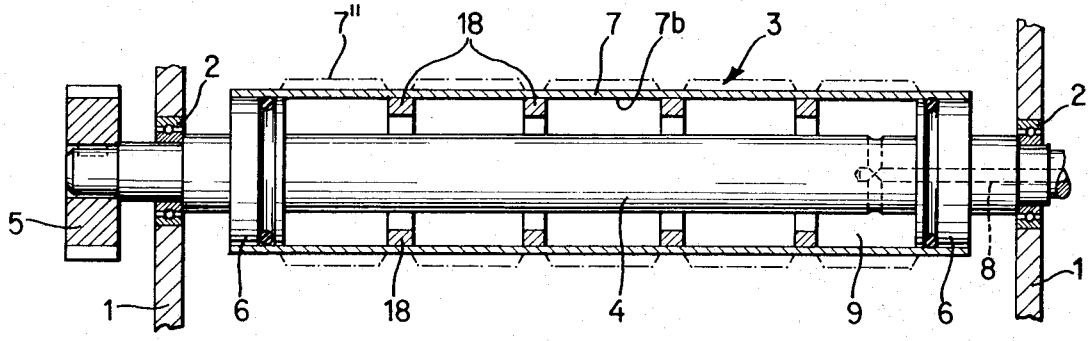
FIG. 3 is an axial sectional view of a modified roll wherein the internal surface of the shell is provided with a set of equidistant annular stiffening or reinforcing ribs.

FIG. 3 shows a modified roll 3 which is substantially identical with the roll of the apparatus shown in FIGS. 1–2 except that the thickness of the wall of the shell 7 is not constant. This is due to the fact that the internal surface **7*b* of the shell 7 which is shown in FIG. 3 is provided with equidistant annular reinforcing or stiffening ribs 18 which extend inwardly from the internal surface 7*b* into the compartment 9. The purpose of the ribs 18 is to increase the resistance of the corresponding portions of the shell 7 to deformation by the fluid medium which is confined in the compartment 9 so that, when the diameter of the shell 7 is increased in order to transport a relatively thin web (not shown in FIG. 3), the external surface of the shell 7 assumes a undulate shape as indicated at 7''**. The undulate shape is desirable in connection with the transport of certain types of webs because the webs are less likely to travel sideways in the axial direction of the roll.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Web transporting apparatus comprising a roll including an elastically deformable hollow cylindrical shell having a web-engaging external surface and two end portions, and end walls in sealing engagement with said end portions so that the shell and the end walls define a liquid-containing internal compartment; regulating means for varying the diameter of said shell, including means for varying the pressure of liquid in said compartment; and means for maintaining the liquid in said compartment at a pressure which is selected by said regulating means, said regulating and maintaining means including hydropneumatic transducer means having a hydraulic cylinder and piston unit forming part of one of said regulating and maintaining means and a pneumatic cylinder and piston unit forming part of the other of said regulating and maintaining means.

2. The apparatus of claim 1, wherein said shell is elastically deformable within a predetermined range corresponding to a predetermined range of diameters of said external surface.

3. The apparatus of claim 1, wherein said shell has a wall of substantially constant thickness.

4. The apparatus of claim 1, wherein said shell has an internal surface surrounding said compartment and said shell comprises at least one annular stiffening rib extending from said internal surface into said compartment.

5. The apparatus of claim 4, wherein said shell has a plurality of reinforcing ribs which are spaced apart from each other in the axial direction of the shell and each of which increases the resistance of the corresponding portion of said shell to expansion by the fluid in said compartment.

6. The apparatus of claim 5, wherein said reinforcing ribs are equidistant from each other.

7. The apparatus of claim 1, wherein one of said end walls has at least one passage connecting said compartment with said maintaining means.

8. The apparatus of claim 1, wherein said shell contains a metal.

9. The apparatus of claim 1, wherein said roll comprises a shaft coaxial with said shell and connected to at least one of said end walls, and further comprising means for rotating said shaft.

* * * * *